US006792761B1

(12) United States Patent
Aschenbruck et al.

(10) Patent No.: US 6,792,761 B1
(45) Date of Patent: Sep. 21, 2004

(54) SYSTEM FOR BURNING A PROCESSED FUEL GAS

(75) Inventors: Emil Aschenbruck, Duisburg (DE); Hans Weibel, Geldern (DE); Markus Beukenberg, Mülheim (DE)

(73) Assignee: Man Turbomaschinen AG GHH Borsig, Oberhausen (DE)

( * ) Notice: Subject to any disclaimer, the term of this patent is extended or adjusted under 35 U.S.C. 154(b) by 855 days.

(21) Appl. No.: 09/712,080

(22) Filed: Nov. 14, 2000

(30) Foreign Application Priority Data

Nov. 19, 1999 (DE) ..... 199 55 680

(51) Int. Cl.[7] ..... F02C 3/22
(52) U.S. Cl. ..... 60/779; 60/39.465; 60/803
(58) Field of Search ..... 60/39.091, 39.465, 60/934, 772, 779, 803

(56) References Cited

U.S. PATENT DOCUMENTS 4,140,473 A 2/1979 Hoehing et al.
4,369,803 A 1/1983 Furr
5,899,073 A * 5/1999 Akimaru ..... 60/39.465
6,401,459 B1 * 6/2002 Tiras ..... 60/772

FOREIGN PATENT DOCUMENTS

| | | |
|---|---|---|
| EP | 04 73 537 A1 | 3/1992 |
| EP | 0 780 632 | 6/1997 |
| FR | 2 296 811 | 7/1976 |
| GB | 1 390 643 | 4/1975 |
| GB | 2 300 451 | 11/1996 |

* cited by examiner

*Primary Examiner*—Louis J. Casaregola
(74) *Attorney, Agent, or Firm*—McGlew and Tuttle, P.C.

(57) ABSTRACT

A fuel gas processed and preheated in a processing unit (6) is burned in a gas turbine unit or in a boiler plant. A continuously operating detector (9) for determining the condensate content in the processed fuel gas is arranged in a line (5) connecting the processing unit (6) with the burner immediately before the burner. This detector (9) is connected to an alarm device (10) and to a shut off device (11).

7 Claims, 1 Drawing Sheet

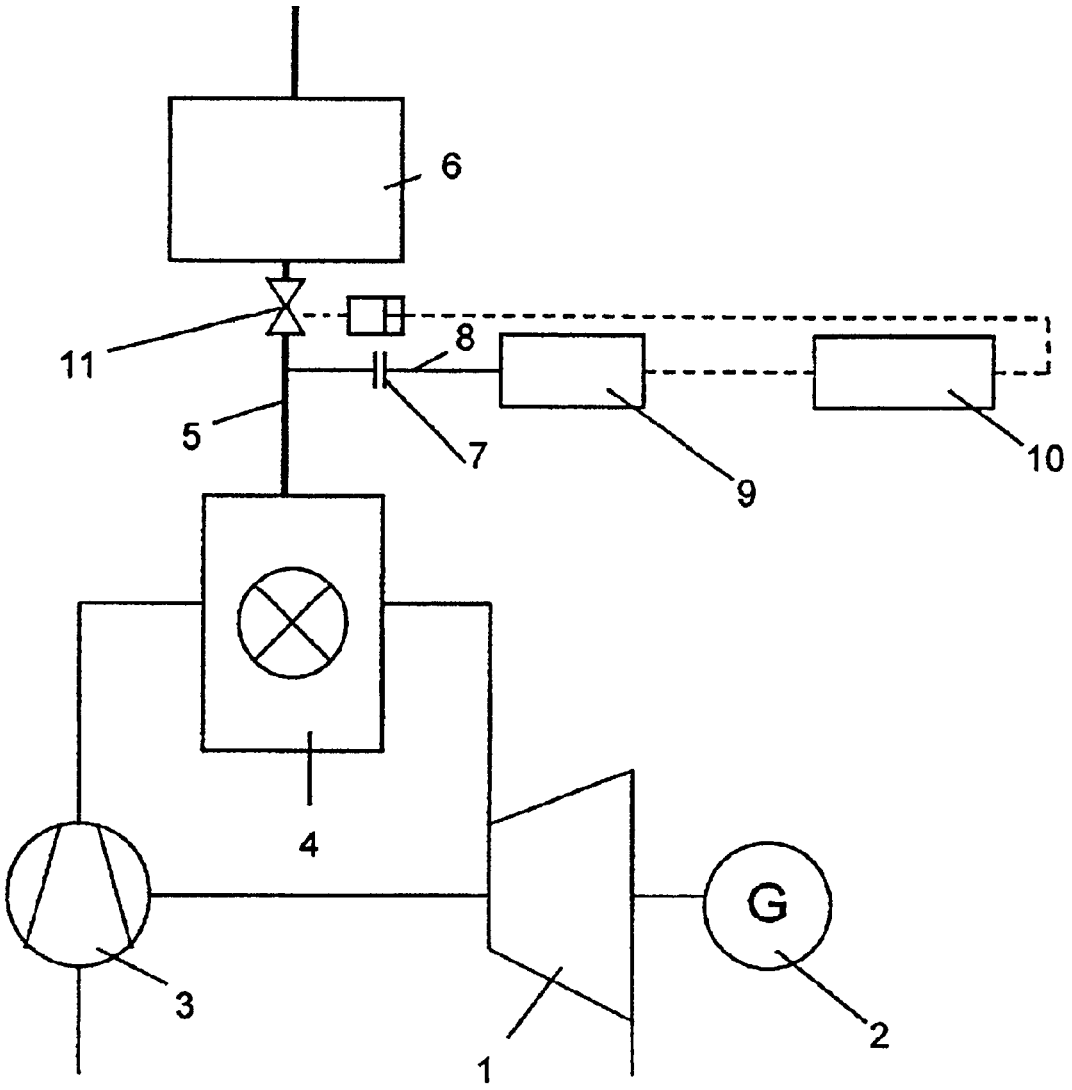
6
11
8
5
7
9
10
4
G
3
1
2

SYSTEM FOR BURNING A PROCESSED FUEL GAS

FIELD OF THE INVENTION

The present invention pertains to a system for burning a fuel gas processed and preheated in a processing unit in a burner in a gas turbine unit or in a boiler plant.

BACKGROUND OF THE INVENTION

Fuel gas is increasingly used to operate gas turbine units and boiler plants. Due to irregularities in the processing of fuel gas (e.g., natural gas) or great fluctuations in the quality of the fuel gas, fuel condensate may precipitate unnoticed. Since the fuel nozzles designed for operation with gas do not atomize the liquid components of the fuel gas, these liquid components are transported through the combustion space proper without participating in the combustion because of the high kinetic energy. If these high-energy liquid drops then come into contact with machine or unit parts, the liquid drops are atomized by the energy of the impact. Ignitable mixtures are formed due to the atomization and due to the air present, and these mixtures cause uncontrolled combustion processes due to flashback. Since the areas affected are not designed for combustion temperatures, the extent of damage is considerable in such cases and it may even lead to complete failure of the machine or unit. The solutions used hitherto to avoid these drawbacks are focused on making the processing of the fuel gas more reliable at a great effort.

SUMMARY AND OBJECTS OF THE INVENTION

The basic object of the present invention is to protect the unit parts located downstream of the burner in a unit of this type from damage from condensate parts possibly present in the fuel gas more reliably and at a reduced effort.

According to the invention a system for burning a fuel gas is provided in which the gas is processed and preheated in a processing unit, in a burner in a gas turbine unit or in a boiler plant. The burner is connected via a line to the processing unit. A continuously operating detector is provided for determining the condensate content in the processed fuel gas. The detector is arranged in the line immediately before the burner. The detector is connected to an alarm and a shut-off.

The final state of the processed fuel gas is monitored by the detector arranged immediately before the burner. A high level of protection of the machine and unit is achieved by this monitoring and by the measures to be taken thereafter. In addition, unnecessary increased safety margins are eliminated during the heating of the fuel gas, so that it becomes possible to reduce the secondary energies. Likewise, malfunctions in the fuel gas processing (filtration, condensate separator, fuel gas heating) as well as variations in the quality of the fuel gas are continuously checked with respect to the precipitation of condensate in the end product of the fuel processing.

An exemplary embodiment of the present invention is shown in the drawing and will be explained in greater detail below.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

BRIEF DESCRIPTION OF THE DRAWING

In the drawing:

The only FIGURE is a schematic view of a gas turbine unit according to the invention.

DESCRIPTION OF THE PREFERRED EMBODIMENT

Referring to the drawings in particular, the gas turbine unit comprises a gas turbine 1, which is coupled with a generator 2 for generating electricity and with a compressor 3 for compressing combustion air. The compressor 3 delivers the compressed combustion air to a combustion chamber 4, in which the processed fuel gas is burned under pressure. The combustion gas formed in the process is fed to the inlet of the gas turbine 1.

The combustion chamber 4 is provided with a burner, which is connected to a processing unit 6 via a line 5. The fuel gas is filtered, freed from condensate and preheated in this processing unit 6. The fuel gas thus processed is fed to the burner of the combustion chamber 4 via the line 5.

A connection 7 for a test line 8, via which a partial stream of the fuel gas being fed via the line 5 is removed, is arranged in the line 5 in the immediate vicinity of the entry into the burner. The test line 8 is connected to a continuously operating detector 9. The condensate content in the fuel gas is determined in the detector 9.

The detector 9 is provided with an alarm device 10 and with a shut-off device 11. When the detector 9 determines an excessively high condensate content in the fuel gas, an alarm is triggered via the alarm device 10 and the feed of fuel gas to the burner is interrupted via the shut-off device 11.

Instead of in a gas turbine unit, the system described may also be used in a boiler plant.

While specific embodiments of the invention have been shown and described in detail to illustrate the application of the principles of the invention, it will be understood that the invention may be embodied otherwise without departing from such principles.

What is claimed is:

1. A system for burning a fuel gas, the system comprising:

a processing unit for processing and preheating the gas;

a gas line;

a burner connected to said processing unit via said gas line;

a gas turbine unit or a boiler plant operatively connected to said burner;

a continuously operating detector for determining the condensate content in the processed fuel gas, said detector being arranged connected to said line before said burner.

an alarm device connected to said detector; and a shutoff device connected to said detector.

2. A system according to claim 1, wherein said shut-off device includes a valve connected to said detector via said alarm device.

3. A system for burning a fuel gas, the system comprising:

a processing unit for processing gas;

a gas line;

a burner connected to said processing unit via said gas line;

a gas turbine unit or a boiler plant operatively connected to said burner;

a continuously operating detector for determining the condensate content in the processed fuel gas, said detector being arranged connected to said line before said burner.

4. A system according to claim 3, further comprising:

an alarm device connected to said detector; and a shut-off device connected to said detector wherein said shut-off device includes a valve connected to said detector via said alarm device.

5. A method for burning a fuel gas, the method comprising the steps of:

processing and preheating fuel gas;

conveying the processed fuel gas in a gas line to a burner;

burning the conveyed fuel gas in the burner to generate combustion gas;

feeding the combustion gas to a gas turbine unit or a boiler plant;

continuously operating a detector during said step of conveying for determining the condensate content in the processed fuel gas being conveyed; and triggering an alarm signal when the detector determines the fuel gas has reached a condensate content above a threshold.

6. A method for burning a fuel gas according to claim 5, further comprising the steps of:

providing a shut-off device connected to said detector for shutting off said conveying of fuel gas wherein said shut-off device responds to said alarm signal.

7. A method according to claim 6, wherein said shut-off device includes a valve connected to said detector via an alarm device, said alarm device for generating said alarm signal.

* * * * *